US005172806A

United States Patent [19]

Mickelberg

[11] Patent Number: 5,172,806

[45] Date of Patent: Dec. 22, 1992

[54] ANIMATED TOY IN PACKAGE

[75] Inventor: Stephen R. Mickelberg, Longport, N.J.

[73] Assignee: S. R. Mickelberg Company, Inc., Jenkintown, Pa.

[21] Appl. No.: 792,328

[22] Filed: Nov. 8, 1991

[51] Int. Cl.[5] ..... B65D 25/00

[52] U.S. Cl. ..... 206/45.31; 206/45.34; 206/459.5

[58] Field of Search ..... 206/45.31, 45.34, 459, 206/457, 458

[56] References Cited

U.S. PATENT DOCUMENTS

| | | | |
|---|---|---|---|
| 610,291 | 9/1898 | Thorens . | |
| 1,604,750 | 10/1926 | Grubman . | |
| 2,395,179 | 2/1946 | Genjack . | |
| 2,697,297 | 12/1954 | Newberg . | |
| 2,810,987 | 10/1957 | Denbow . | |
| 2,868,361 | 1/1959 | Zilem et al. | 206/15.1 |
| 3,413,756 | 12/1968 | Gardel et al. . | |
| 3,429,428 | 2/1969 | Fowler | 206/45.31 |
| 3,514,899 | 4/1970 | Bonanno et al. . | |
| 3,533,503 | 10/1970 | Wood et al. | 206/45.19 |
| 3,796,005 | 3/1974 | Chang et al. . | |
| 3,811,565 | 5/1974 | Tancredi | 206/478 |
| 3,847,276 | 11/1974 | Lehner et al. | 206/45 |
| 3,977,292 | 8/1976 | Favilli et al. | 84/470 |
| 4,121,416 | 10/1978 | Niemczyk . | |
| 4,129,210 | 12/1978 | Brown et al. | 206/45.31 |
| 4,175,353 | 11/1979 | Pickett . | |
| 4,185,739 | 1/1980 | Wilford | 206/45.14 |
| 4,221,454 | 9/1980 | Wong . | |
| 4,237,647 | 12/1980 | Shaw . | |
| 4,249,338 | 2/1981 | Wexler . | |
| 4,261,466 | 4/1981 | Wilford | 206/335 |
| 4,696,653 | 9/1987 | McKeefery | 446/175 |
| 4,702,374 | 10/1987 | Kelner | 206/418 |
| 4,740,187 | 4/1988 | Rasmussen et al. | 446/73 |
| 4,767,374 | 8/1988 | Yang | 446/301 |
| 4,820,236 | 4/1989 | Berliner et al. | 446/369 |
| 4,848,577 | 7/1989 | Hoffman et al. | 206/467 |
| 4,867,726 | 9/1989 | Fujimaki | 446/175 |
| 4,925,025 | 5/1990 | Anten et al. | 206/335 |

FOREIGN PATENT DOCUMENTS

| | | | |
|---|---|---|---|
| 2036632 | 12/1970 | France | 206/45.34 |
| 465739 | 5/1937 | United Kingdom | 206/45.31 |

*Primary Examiner*—William I. Price

*Attorney, Agent, or Firm*—Caesar, Rivise, Bernstein, Cohen & Pokotilow, Ltd.

[57] ABSTRACT

An animated toy with articulated moving parts in a package is disclosed. An opening in the package allows a person to operate a switch to activate the toy. When the toy is activated, the moving articulated parts can be observed through openings in the package or alternatively through transparent sections in the package. In addition, lights can be activated and flashed and an enunciator can be employed to emit sounds which are seen and heard by the person while the animated toy is in the package.

19 Claims, 4 Drawing Sheets

ANIMATED TOY IN PACKAGE

FIELD OF THE INVENTION

The present invention relates to packages used for the shipment and display of toys, and more particularly to packaging for animated toys which can be activated while the toys are within the shipment display package at selling locations.

BACKGROUND OF THE INVENTION

It is a well known selling tool for toys that the chances of selling a toy are substantially enhanced if the purchaser can operate the toy and see how it operates at the point of sale. Thus, toys such as guns and rifles which incorporate flashing lights and the sounds of a firing weapon are now packaged so that the trigger of the gun can be operated while the gun is still in its display package. In this case, the gun is packaged in an open frame with one side missing so that a person can operate the trigger of the gun while it is still mounted in the package.

In addition, dolls are placed in packages with a ring and a pull string so that when the string is pulled the doll can emit sounds while it is still in the package.

Anten et al., U.S. Pat. No. 4,925,025 discloses a toy within a point of sale package display which is activated while the toy is within the package. It uses two batteries, one is an inexpensive battery which is supplied for display operation only. After purchase, when the device is removed from the package, the temporary battery is removed from the battery compartment and two normal sized AA batteries placed therein for operation.

Although the prior art does disclose toys which can be operated while in their display packages, these toys are inanimate and in the operation of the toy in the package comprises emitting lights or sound or the movement of inarticulated (non-jointed) parts only.

OBJECTS OF THE INVENTION

Accordingly, it is the general object of this invention to provide a package for an animated toy which can be activated within its package which allows the purchaser to observe the movement of articulated (jointed) parts of the toy as well as to hear and observe sounds and lights emitted by the toy when the toy is activated.

It is a further object of this invention to provide a shipment and display package for an animated toy which can be activated in its package which allows for access to the activating means while the toy is in the package.

It is yet a further object of this invention to provide a package for an animated toy which can be activated in its package which provides means for observing the movement of articulated parts of the toy when it is activated.

It is still yet a further object of the instant invention to provide a package for an animated toy which can be activated in its package which has the means to deactivate the toy after it has been activated for a pre-determined amount of time.

It is another object of this invention to provide a package for an animated toy which can be activated in its package which does not require replacement of batteries after sale of the toy.

It is still another object of this invention to provide a package for an animated toy which can be activated in its package which has openings in the package for allowing access to the means to activate the toy while it is in the package.

It is still yet another object of this invention to provide a package for an animated toy which can be activated in its package which has openings in the package for the observation of the movement of articulated parts when a toy is activated.

It is an additional object of this invention to provide a package for an articulated toy which can be activated in its package which has transparent sections for the observation of the movement of the articulated parts of the toy when it is activated.

SUMMARY OF THE INVENTION

These and other objects of this invention are achieved by providing an animated toy with articulated parts which can be activated while it is in its display package so that a purchaser can hear the sounds emitted by the toy, see the lights emitted by the toy, and observe the movement of articulated parts of the toy when the toy is activated. The term "articulated parts", as used herein, means jointed parts such as the limbs, head, legs, wings or tails of living beings (e.g. humans or animals, or representations of living beings such as dolls, stuffed animals, robots, monsters, creatures, reptiles, birds, and the like). The toy is packaged for transportation and for display purposes in a box which has openings for operating and means for activating a toy and openings for observing the motion of articulated parts while it is still within the box.

The toy is placed on an insert inside the package to properly position the toy and to allow for an ambulatory motion, e.g. walking, trotting, or running, in the package.

Alternatively, rather than an opening to allow one to activate the toy, a membrane-like section can be used to allow the purchaser to activate the toy by applying pressure to the means for activation of the toy such as an electric switch. Also instead of providing openings for the observation of the movement of the articulated parts of the toy, the package can include transparent sections or blisters which will allow for the observation of the movement of the articulated parts.

In order to save battery power, the device times out and deactivates upon the passage of a pre-determined amount of time after activation.

DESCRIPTION OF THE DRAWING

Other objects and many of the intended advantages of this invention will be readily appreciated when the same becomes better understood by reference to the following detailed description when considered in connection with the accompanying drawing wherein.

DETAILED DESCRIPTION AND PREFERRED EMBODIMENT

Figure 1:
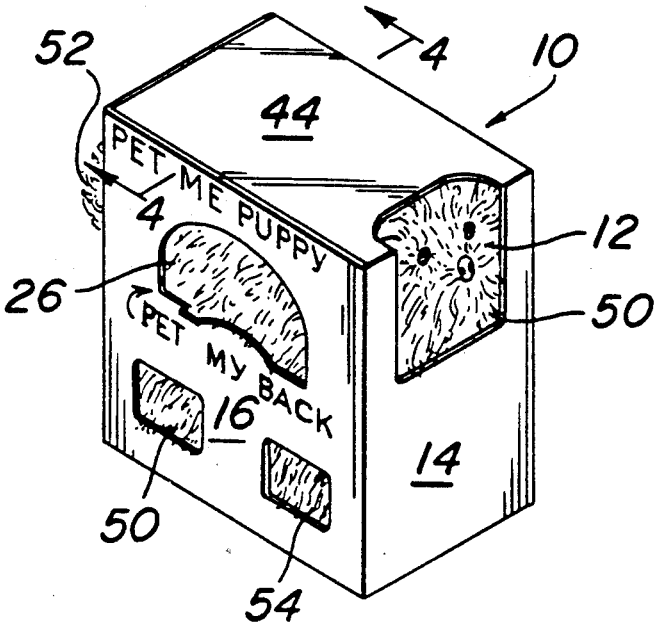
FIG. 1 is an isometric view of the animated toy in its package.

Referring now in greater detail to the various figures of the drawing, wherein like referenced characters refer to like parts, the package 10 for the animated toy is shown in FIG. 1. The animated toy, 12, in this case a puppy, is placed within the package 10. The toy is shipped as shown and placed on display at the selling location in the package 10.

Figure 4:
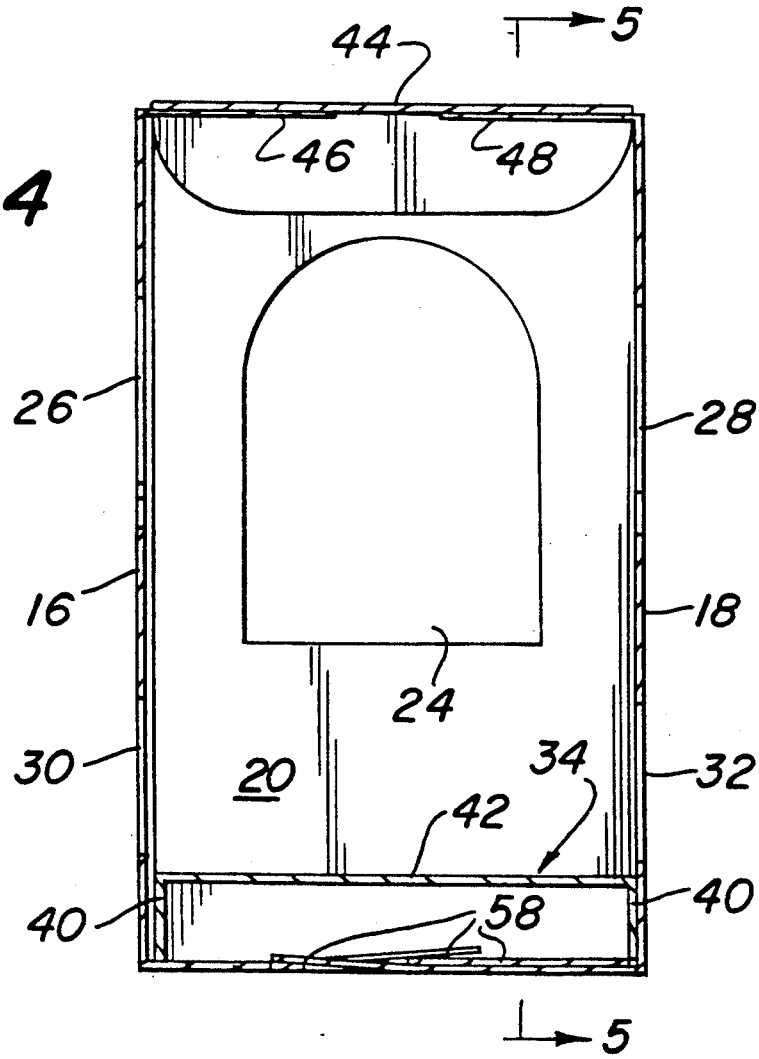
FIG. 4 is a sectional view of the package taken along the line 4—4 of FIG. 1.
Figure 2:
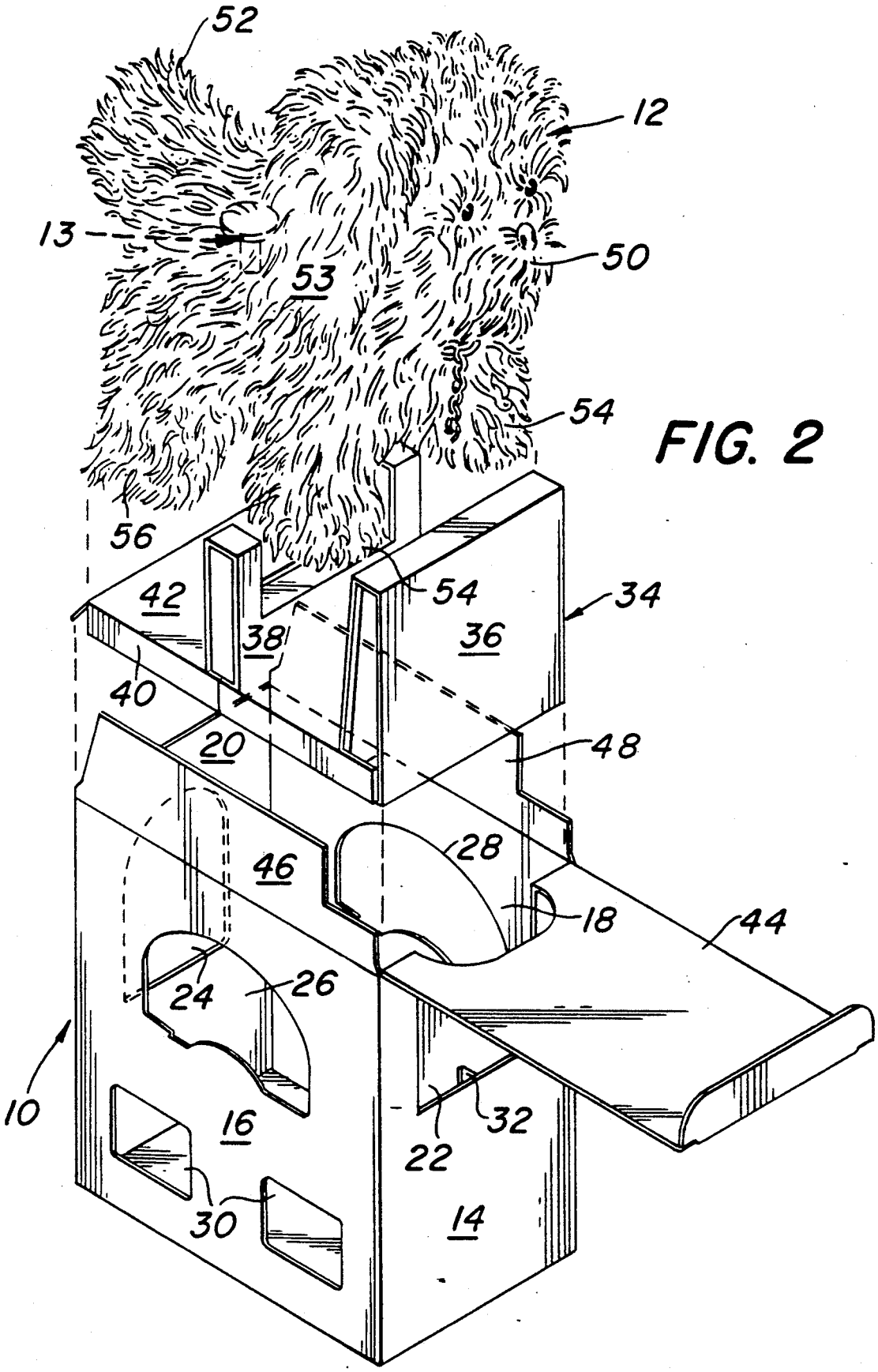
FIG. 2 is an isometric exploded view of the package, the insert placed in the package, and the animated toy positioned on the insert.

As can be seen in FIGS. 1, 2, and 4, the package 10 comprises front wall 14, side walls 16 and 18, and rear wall 20, front opening 22. The front opening 22 allows visibility of the head 50 of the toy 12, which extends beyond front wall 14. The side walls 16 and 18 have openings 30 for observation of the paws 54 and 56 of the toy dog 12. Openings 26 in side walls 16 and 18 allow a person to reach within the package and by petting the back of the toy 12 to depress electrical switch 13 which activates the toy. Instructions to operate the toy in the package are printed near openings 26. Openings 26 also allow visibility of the ears 53 of the toy 12. Rear wall 20 has an opening 24 through which the tail of the toy 12 extends.

When the electrical switch 13 is depressed, the toy 12 starts to walk, its tail 52 wags, its head 50 nods, and an annunciator emits the sound of barking. The movement of the head 50, the wagging of the tail 52, and the walking of the dog, i.e. the movement of its paws 54 and 56, can be observed through openings 22, 24, and 30 respectively.

Figure 3:
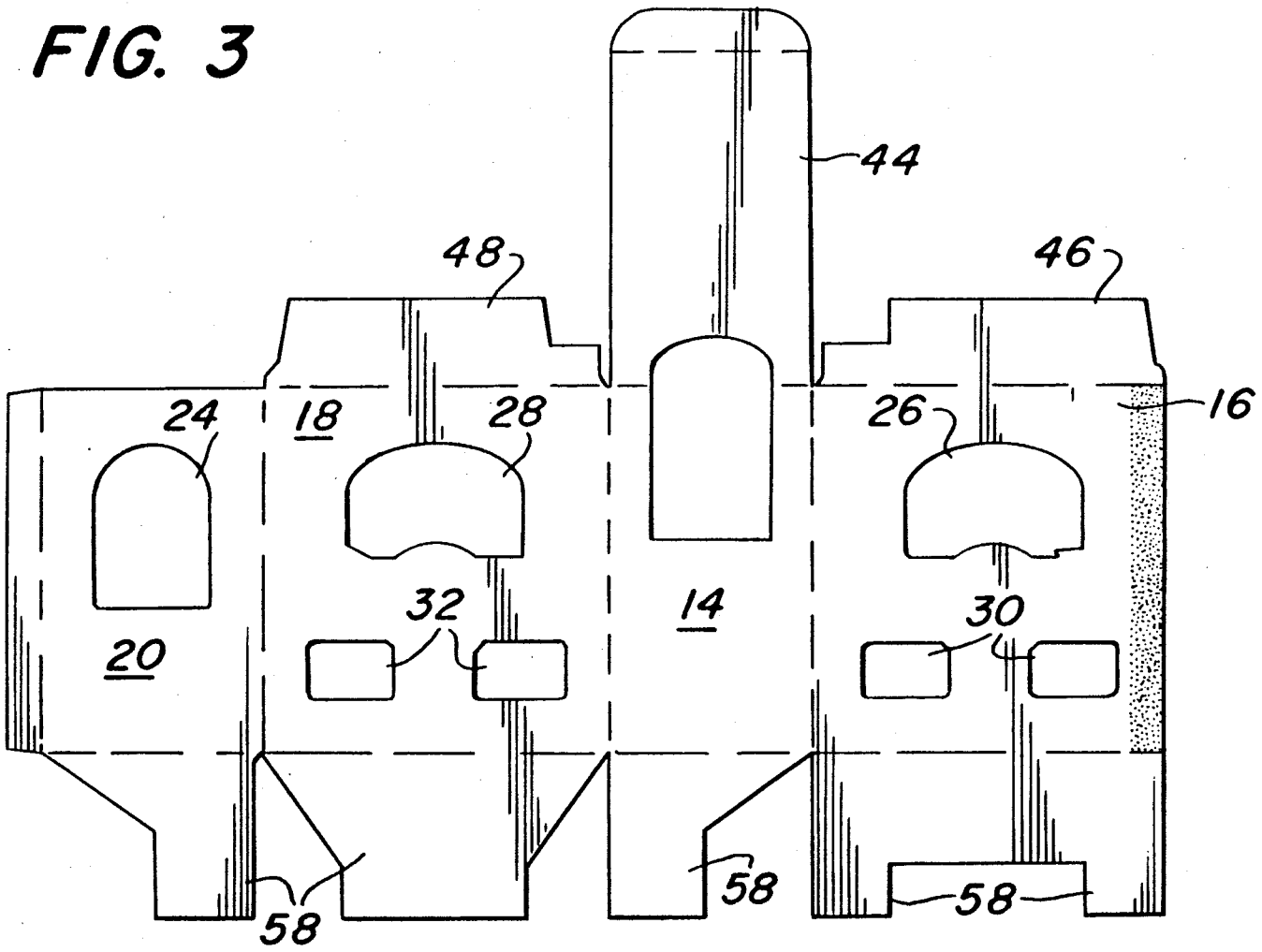
FIG. 3 is a top plan view of the unitary package prior to folding and gluing.

FIG. 3 shows a plain view of the unitary package after it has been stamped and scored, prior to folding and gluing. As can be seen, in addition to the front wall 14, the rear wall 20, and the side walls 16 and 18, the package includes side flaps 46 and 48 and top flap 44. Also shown are interlocking lower tabs 58 which form the bottom wall of the package.

Figure 5:
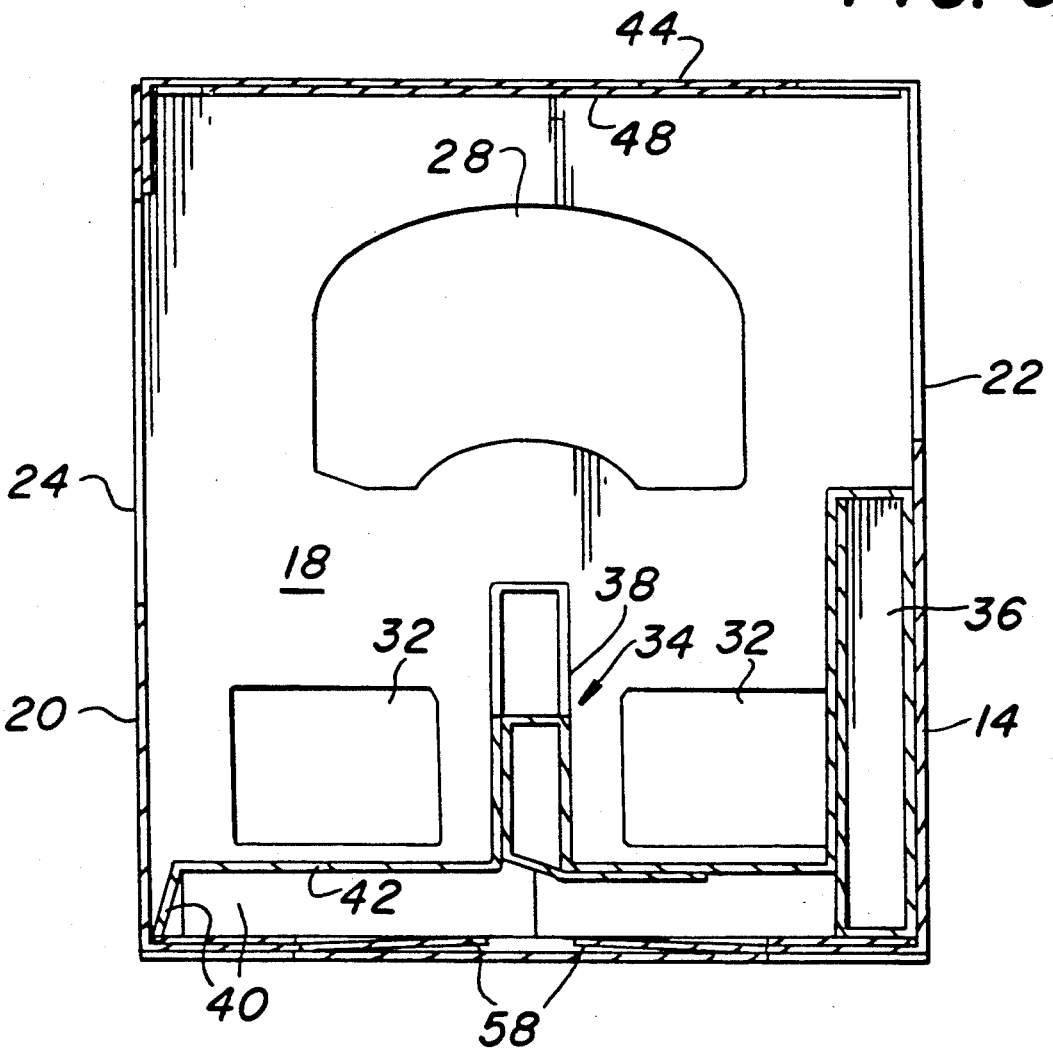
FIG. 5 is a sectional view of the package taken along the line 5—5 of FIG. 4.

After the package has been formed, the insert 34 is placed into the package as shown in FIGS. 2 and 5. The insert 32 has a forward section 36 and a rear section 38. The toy 12 is placed in the box o the insert 34 with its front paws 54 between forward section 36 and rear section 38, and with its rear paws 56 behind rear section 38. This allows the toy 12 to walk in place with his legs in motion on bottom surface 42 of the insert 34. Bottom surface 42 is raised from the bottom of package 10 by side panels 40. After the toy 12 has been placed within a package 10 on the insert 34, side flaps 46 and 48 are folded inward and top flap 44 is folded to close the package.

It should be kept in mind that although the toy 12 has been described herein as a puppy, any other kind of animated toy with articulated moving parts can be packaged in accordance with this invention so that the toy can be activated and be observed while it is still within its display package.

The operation of the mechanism to move the articulated parts, the enunciator to emit sounds, and the electrical switch are standard and well known to those familiar with the art.

Although the embodiment enclosed herein discloses openings in the package for observing the movement of articulated parts, alternatively, transparent sections can be used for such observation. Furthermore, rather than an opening to operate an electrical switch, a membrane-like material can be placed in the package so that pressure from outside the package can be used to activate the switch. Finally, although the tail of the toy 12 extends beyond the wall of the package 10, transparent blisters can be used to allow parts of the toy to extend beyond the surface of the package.

Without further elaboration, the foregoing will so fully illustrate my invention that others may by applying current or future knowledge readily adapt the same for use under the various conditions of service.

I claim:

1. A package for an animated toy, said animated toy, said animated toy comprising at least one articulated moveable part and means for activating said at least one articulated part and said package comprising at least one wall, means in said at least one wall for accessing said activating means while said toy is in its package, means for allowing said animated toy to ambulate within said package and means in said at least one wall for observing the movement of said at least one articulated part when said toy is activated in said package.

2. The package of claim 1 wherein said means for accessing said activating means comprises at least one first opening in said at least one wall through which a person can insert the fingers of a hand to operate said activating means.

3. The package of claim 2 wherein means for observing the movement of said articulated parts comprises at least one second opening in said at least one wall through which said at least one articulated moveable part can be observed when said toy is activated.

4. The package of claim 3 wherein said at least one articulated part extends beyond said at least one wall.

5. The package of claim 4 wherein said means to allow said to ambulate comprises an insert upon which said toy can be placed when in said package.

6. The package of claim 5 wherein said at least one wall comprises a front wall, a rear wall, opposing side walls, a bottom wall and a top flap.

7. The package of claim 6 wherein said package further comprises a unitary form and said form is folded and glued to produce a package into which said animated toy is placed for shipment to, and for display at, a sales location.

8. The package of claim 7 wherein said package further comprises directions, printed on said package, for instructing said persons in activating said animated toy while it is in said package.

9. The package of claim 8 wherein said means to activate said articulated parts comprises an electrical switch.

10. The package of claim 1 wherein said means for accessing said activating means comprises a membrane-like material on said package which may be depressed to operate said activating means.

11. The package of claim 10 wherein said means for observing the movement of said articulated parts comprises at least one opening in said at least one wall through which said at least one articulated part can be observed when said toy is activated.

12. The package of claim 1 wherein said means for observing the movement of said at least one articulated part comprises at least one transparent section in said package.

13. The package of claim 12 wherein said at least one articulated part extends beyond said at least one wall.

14. The package of claim 13 wherein said at least one wall comprises a front wall, a rear wall, opposing side walls, a bottom wall and a top flap.

15. The package of claim 13 wherein said means to sallow said toy to ambulate comprises an insert upon which said toy can be placed when in said package.

16. The package of claim 15 wherein said package further comprises a unitary form and said form is folded and glued to produce a package into which said animated toy is placed for shipment to, and for display at, a sales location.

17. The package of claim 16 said package further comprises directions, printed on said package, for instructing said persons in activating said animated toy while it is in said package.

18. The package of claim 17 wherein said means to activate, said articulated parts comprises an electrical switch.

19. The package of claim 1 wherein said animated toy further comprises enunciating means which is responsive to said activation means.

* * * * *